US005333355A

United States Patent [19]

Beswick et al.

[11] Patent Number: 5,333,355

[45] Date of Patent: Aug. 2, 1994

[54] ADJUSTABLE AUTOMATIC DOOR CLOSURE APPARATUS AND METHOD FOR USE THEREOF

[76] Inventors: Duane Beswick, 2489 N. Burlingham Pl., Simi Valley, Calif. 93063; Robert Enriquez, 13302 Kamloops, Arleta, Calif. 91331

[21] Appl. No.: 961,586

[22] Filed: Oct. 15, 1992

[51] Int. Cl.[5] ..... E05F 1/08

[52] U.S. Cl. ..... 16/300; 16/75

[58] Field of Search ..... 16/300, 308, 301, 75

[56] References Cited

U.S. PATENT DOCUMENTS

| | | | |
|---|---|---|---|
| 998,692 | 7/1911 | Keene et al. | 16/300 |
| 1,334,563 | 3/1920 | Shelton | 16/300 |
| 3,339,225 | 9/1967 | Booth | 16/300 |
| 3,507,074 | 4/1970 | Gallegos | 16/75 |
| 3,702,491 | 11/1972 | Pelletiere | 16/301 |
| 4,692,963 | 9/1987 | Barroero | 16/301 |
| 4,696,078 | 9/1987 | Stromquist | 16/301 |
| 4,905,347 | 3/1990 | Worth | 16/308 |

*Primary Examiner*—P. Austin Bradley
*Assistant Examiner*—Chuck Y. Mah
*Attorney, Agent, or Firm*—John J. Posta, Jr.

[57] ABSTRACT

An apparatus and related method for use to automatically close display doors for display cases and the like is disclosed which allows the amount of door closing preloading bias to be easily and quickly adjusted with a high degree of precision to vary the amount of force used to close a display door. A display pivot member having an adjustment wheel is placed into engagement with a base member having a mechanism allowing rotation of the display pivot member only in a direction increasing the preloading bias on a biasing member located in the display door and used to close the display door. The base member includes an access slot to release the display pivot member, allowing it to rotate in the opposite direction to release the bias on the biasing member to allow the adjustment operation to be redone.

16 Claims, 3 Drawing Sheets

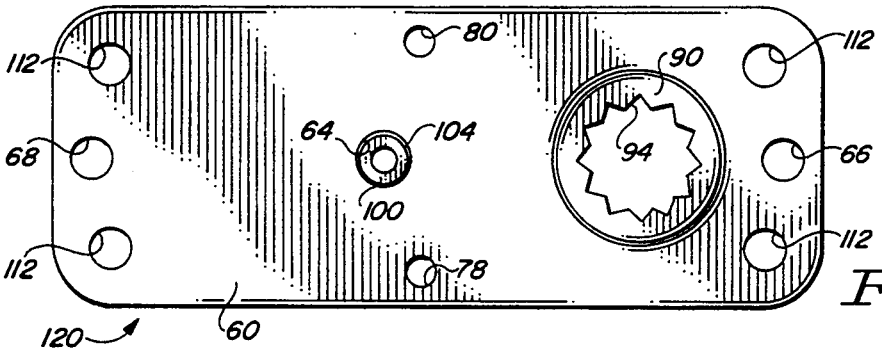
FIG. 10
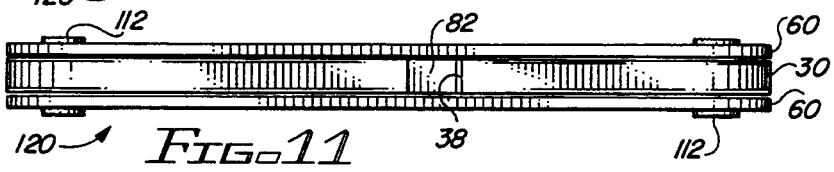
FIG. 11
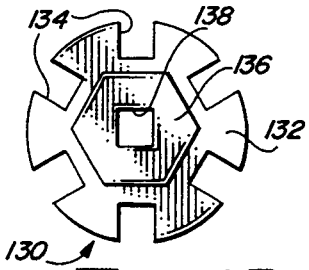
FIG. 12
FIG. 13
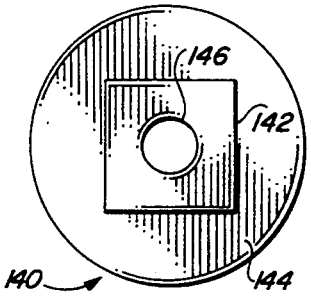
FIG. 14
FIG. 15
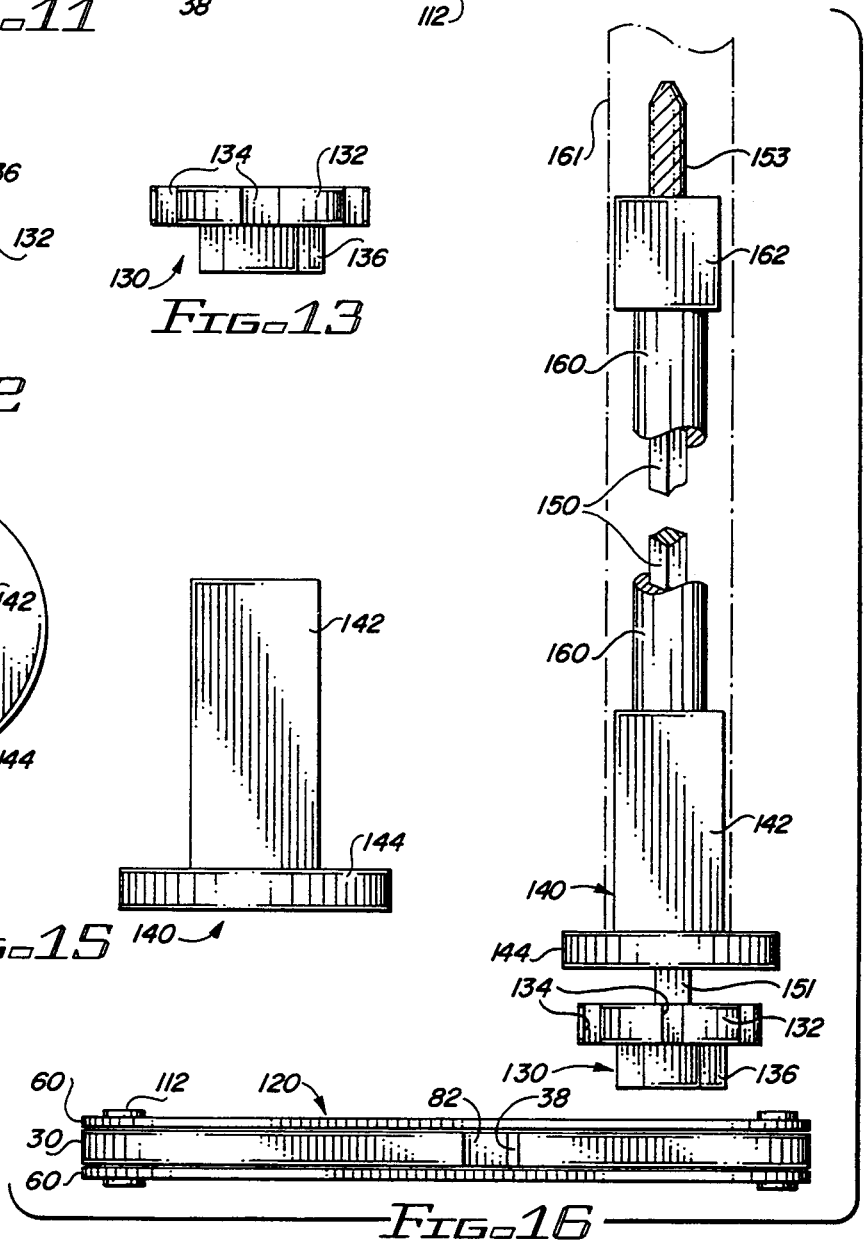
FIG. 16

ADJUSTABLE AUTOMATIC DOOR CLOSURE APPARATUS AND METHOD FOR USE THEREOF

BACKGROUND OF THE INVENTION

Field Of the Invention

The present invention relates generally to automatically closing display doors for display cases and the like, and more particularly to an improved door closure mechanism and a related method for use therewith which allows the amount of door closing preloading bias to be easily and quickly adjusted with a high degree of precision to vary the amount of force used to close a display door.

Display cases having display doors containing windows therein are widely used, particularly for applications such as in supermarkets to display refrigerated and frozen foods. The display doors function to retain the cold air within the display cases, thereby conserving energy and reducing operating costs while also efficiently keeping the foods contained therein cold. Since it is common for consumers or their children to forget to securely close the display doors, most such display doors include a closing mechanism therein.

Such closing mechanisms must typically be adjusted when the display doors are first installed, and also at periodic intervals over time to compensate for changes in operating condition such as increased friction, the buildup of dirt, or the loss of elasticity in the element used to bias the display doors from an open position to the closed position. Accordingly, in better quality display doors an adjustment mechanism is included.

One such closing mechanism uses an adjustment mechanism which is located at the bottom of the display door, and which is accessible from the outside of the display case. A cylindrical display pivot element is carried on the bottom of the display door, and is received in a door closer base member mounted on top of the bottom frame member of the display case in which the display door is mounted. The cylindrical display pivot element has a plurality of radially oriented apertures evenly spaced around the outer periphery thereof.

The portion of the cylindrical display pivot element having the plurality of radially extending apertures located therein is received within the door closer base member. The door closer base member has an aperture in the front side thereof which aperture is sufficiently wide to allow access to two adjacent ones of the plurality of radially extending apertures located in the cylindrical display pivot element when the cylindrical display pivot element is received in the door closer base member. By using a pair of pins placed sequentially in the apertures in the cylindrical display pivot element, the cylindrical display pivot element can be rotated to increase or decrease the bias which will be exerted by the biasing member used to close the display door.

When the rotational position of the cylindrical display pivot element with respect to the door closer base member has been made to properly adjust the biasing member, a set pin may be placed in one of the apertures in the cylindrical display pivot element to prevent it from rotating further with respect to the door closer base member. It will be appreciated by those skilled in the art that this adjustment mechanism represents something less than perfection in mechanical design. In addition to being difficult to adjust, this mechanism is also susceptible to total failure whenever the set pin works its way out of the cylindrical display pivot element, leaving the display door closing mechanism totally inoperative.

It is accordingly the primary objective of the present invention that it provide an improved adjustment mechanism for adjusting the bias which will be exerted by the biasing member used to close the display door. As such, the improved door closer adjustment mechanism of the present invention should be improved in two aspects. First, the improved door closer adjustment mechanism of the present invention should be easier to adjust than previously known door closer mechanisms, allowing a user to easily and precisely adjust the degree of bias which will be exerted by the biasing member used to close the display door. Second, the improved door closer adjustment mechanism should positively and surely retain the precise adjustment setting over a period of time, and should not be susceptible to the failure mode exhibited by previously known door closer mechanisms.

In addition, it is a further objective of the present invention that the improved door closer mechanism be small in size, not requiring any more space to install than do previously known door closer mechanisms. It is yet another objective of the improved door closer adjustment mechanism of the present invention that it be usable to replace existing door closure mechanisms without requiring either replacement or extensive modification of existing display doors. It is also an objective of the improved door closer mechanism that a single mechanism be usable on either a display door with its pivot point on the right side or a display door with its pivot point on the left side.

The improved door closer mechanism of the present invention must also be of construction which is both durable and long lasting, and it should require little or no maintenance to be provided by the user. In order to enhance the market appeal of the improved door closer mechanism of the present invention, it should also be of inexpensive construction to thereby afford it the broadest possible market. Finally, it is also an objective that all of the aforesaid advantages and objectives of the present invention be achieved without incurring any substantial relative disadvantage.

SUMMARY OF THE INVENTION

The disadvantages and limitations of the background art discussed above are overcome by the present invention. With this invention, an improved door closer mechanism is disclosed which uses a modified display pivot member and a totally new and unique base member. The modified display pivot member of the present invention includes an adjustment wheel mounted at the top thereof, which adjustment wheel may be easily rotated using either a screwdriver or a like tool, or a specially designed wrench.

The lower portion of the display pivot member of the improved door closer mechanism is designed to be inserted in an engaging fashion into the new base member of the present invention. The base member used in the present invention is an adjustment mechanism which allows a display pivot member engaged in the base member to rotate in only one direction. Rotation of the display pivot member in the direction in which rotation of the display pivot member is allowed is used to provide additional preloading bias to the biasing member used to close the display door. Once additional bias in the biasing member is set, it cannot ordinarily be diminished, except by resetting the base member to release the tension, and then readjusting the bias of the biasing member.

In the preferred embodiment, the new base member of the present invention uses a thin ratcheting mechanism to allow the one-way rotation of the display pivot member of the present invention. A ratchet wheel contained within the base member is normally rotatable in only one direction. The lower portion of the display pivot member of the improved door closer mechanism is inserted in an engaging fashion into the ratchet wheel, and thus turns with the ratchet wheel. The display pivot member and the ratchet wheel may be rotated using the adjustment wheel mounted at the top of the display adjustment member.

The base member of the present invention includes a pawl member, which is moveable to allow rotation of the ratchet wheel in only one direction. The pawl member is spring-loaded to inhibit rotation of the ratchet member in the other direction. The base member is very thin, and in the preferred embodiment is less than on-quarter of an inch in total thickness. An aperture in the base member allows the lower portion of the display pivot member of the improved door closer mechanism to be inserted into the ratchet wheel from either side of the base member, thus allowing the base member of the present invention to be used either with a display door with its pivot point on the right left side thereof, or with a display door with its pivot point on the left side thereof.

It may therefore be seen that the present invention teaches an improved adjustment mechanism for adjusting the bias which will be exerted by the biasing member used to close a display door. As such, the improved door closer adjustment mechanism of the present invention features improvements in two significant aspects. First, the improved door closer adjustment mechanism of the present invention is substantially easier to adjust than previously known door closer mechanisms, allowing a user to easily and precisely adjust the degree of bias which will be exerted by the biasing member used to close the display door. Second, the improved door closer adjustment mechanism positively and surely retains the precise adjustment setting over a period of time, and as such is not susceptible to the failure mode exhibited by previously known door closer mechanisms.

In addition, the improved door closer mechanism of the present invention is small in size, and thus does not require any more space to install than do previously known door closer mechanisms. The improved door closer adjustment mechanism of the present invention is also usable to replace existing door closure mechanisms without requiring either replacement of extensive modification of existing display doors. A single mechanism constructed according to the teachings of the present invention is equally usable either on a display door with its pivot point on the right side, or on a display door with its pivot point on the left side.

The improved door closer mechanism of the present invention is also of a construction which is both durable and long lasting, and which requires little or no maintenance to be provided by the display door user. The market appeal of the improved door closer mechanism of the present invention is also enhanced since it is of relatively inexpensive construction to thereby afford it the broadest possible market. Finally, all of the aforesaid advantages and objectives of the present invention are achieved without incurring any substantial relative disadvantage.

DESCRIPTION OF THE DRAWINGS

These and other advantages of the present invention are best understood with reference to the drawings, in which:

FIG. 10 is a top plan view of the base member illustrated in FIG. 9, with one of the base member covers illustrated in FIG. 3 mounted on the top of the base member housing, and with the base member held together with a plurality of rivets;

FIG. 11 is a side view of the base member illustrated in FIG. 10, showing the access slot in the side of the base member housing;

FIG. 12 is a bottom plan view of a display pivot member constructed according to the teachings of the present invention, showing the adjustment wheel located at the top of the display pivot member, and the engagement member located at the bottom of the display pivot member;

FIG. 13 is a side view of the display pivot member illustrated in FIG. 12;

FIG. 14 is a top plan view of a square insertion pin for installation into the top or bottom of a display door at its pivot point, showing the flange on one end thereof and the aperture extending therethrough;

FIG. 15 is a side view of the square insertion pin illustrated in FIG. 14;

FIG. 16 is a partially cut away, partially exploded view of the door closing mechanism of the present invention, showing in addition to the various components of the previous figures the torsion tube used as the biasing mechanism to close a display door, including a rod extending through a tube and connected at the bottom end thereof to the display pivot member illustrated in FIGS. 12 and 13, and a locking member secured to the top end of the rod;

DETAILED DESCRIPTION OF THE PREFERRED EMBODIMENT

The preferred embodiment of the present invention utilizes an improved door closer mechanism to automatically close a display door mounted in the frame of a display case. The key to this improved door closer mechanism is the unique apparatus and method used to adjust the bias in the biasing member which automatically closes a display door. The adjustment mechanism includes two essential elements in addition to the biasing instrumentality. These elements are a modified display pivot member and a base member, the latter of which is particularly of a new and innovative design.

Figure 1:
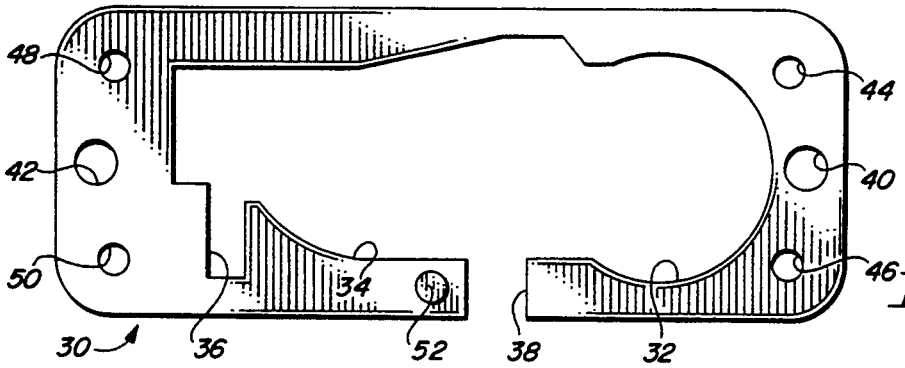
FIG. 1 is a top plan view of a base member housing for the base member of the present invention, showing the configuration of the interior of the base member housing, and the access slot in the side of the base member housing.
Figure 2:
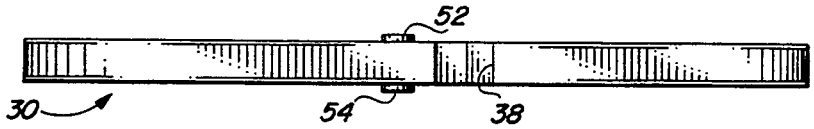
FIG. 2 is a side view of the base member housing illustrated in FIG. 1, showing the access slot in the side of the base member housing, and the pins extending from the top and bottom sides of the base member housing.

The various components of the base member of the present invention are illustrated in FIGS. 1 through 11. Referring first to FIGS. 1 and 2, a base member housing 30 is illustrated. The base member housing 30 is essentially rectangular in configuration as best shown in FIG. 1, and is substantially longer and wider than it is thick. The interior of the base member housing 30 is hollowed out in a complex configuration, which may be described as three communicating segments which may be separately referred to. The three communicating segments all extend entirely through the thickness of the base member housing 30.

A first segment 32 of the hollowed-out interior of the base member housing 30 is essentially circular in configuration, and is located near the right side of the base member housing 30 as shown in FIG. 1. A second segment 34 of the hollowed-out interior of the base member housing 30 is located between the left side of the first segment 32 of the hollowed-out interior of the base member housing 30 and the left side of the base member housing 30. The second segment 34 of the hollowed-out interior of the base member housing 30 is wider nearer the first segment 32 of the hollowed-out interior of the base member housing 30 than it is near the left side of the base member housing 30. The left side of the second segment 34 of the hollowed-out interior of the base member housing 30 is also located closer to the edge of the base member housing 30 shown on the top in the view of FIG. 1 than it is to the edge of the base member housing 30 shown on the bottom in the view of FIG. 1.

Located below the left side of the second segment 34 of the hollowed-out interior of the base member housing 30 as shown in the view of FIG. 1 is a third segment 36 of the hollowed-out interior of the base member housing 30. The third segment 36 of the hollowed-out interior of the base member housing 30 is essentially orthogonal to the second segment 34 of the hollowed-out interior of the base member housing 30, and is quite slender. Located in the side of the base member housing 30 shown on the bottom in FIG. 1 is an access slot 38. The access slot 38 is in communication with the second segment 34 of the hollowed-out interior of the base member housing 30 on the end near the first segment 32 of the hollowed-out interior of the base member housing 30.

Centrally located in the base member housing 30 near the right side thereof as shown in FIG. 1 is an aperture 40. Similarly, centrally located in the base member housing 30 near the left side thereof is an aperture 42. Four additional apertures 44, 46, 48, and 50 are respectively located near the four corners of the base member housing 30. The apertures 44 and 46 are located near the right side of the base member housing 30, while the apertures 48 and 50 are located near the left side of the base member housing 30 as shown in FIG. 1. The apertures 44 and 48 are located near the side of the base member housing 30 shown on the top in FIG. 1, while the apertures 46 and 50 are located near the side of the base member housing 30 shown on the bottom in FIG. 1.

Completing the construction of the base member housing 30 are two pins 52 and 54 extending from the top face and the bottom face respectively of the base member housing 30. The pins 52 and 54 are coaxial, and are located just to the left of the access slot 38 in the base member housing 30. In the preferred embodiment, the base member housing 30 may be made of molded plastic. The size of the base member housing 30 in the preferred embodiment may be one inch wide by two and one-half inches long, and just over one-eighth inch thick.

Figure 3:
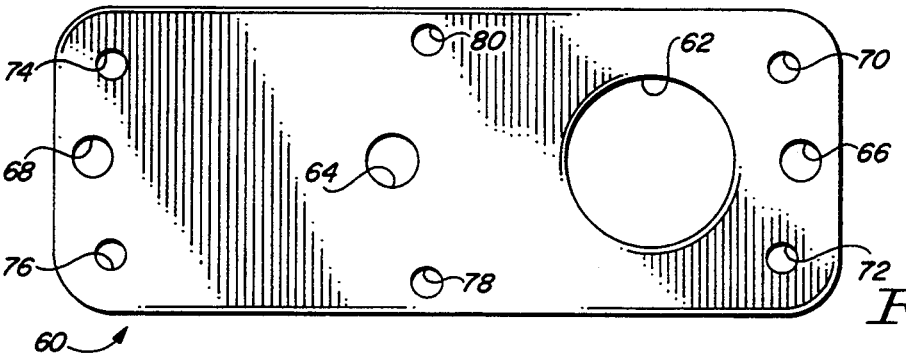
FIG. 3 is a top plan view of a base member cover used on either the top side or the bottom side of the base member housing illustrated in FIGS. 1 and 2.

Referring next to FIG. 3, a base member cover 60 is illustrated which is quite thin. Two of the base member covers 60 will be placed on the top and bottom faces, respectively, of the base member housing 30 when the base member is assembled, as will become evident below. The base member cover 60 has a large circular aperture 62 extending therethrough near the right side thereof as shown. The aperture 62 will be coaxial with and somewhat smaller than the first segment 32 of the hollowed-out interior of the base member housing 30 (FIG. 1) when the base member cover 60 is placed either on the top face or on the bottom face of the base member housing 30.

Located in the base member cover 60 just to the left of center is a smaller aperture 64. The aperture 64 will be located over a portion of the second segment 34 of the hollowed-out interior of the base member housing 30 when the base member cover 60 is placed either on the top face or on the bottom face of the base member housing 30. Located in the base member cover 60 near the right side thereof as shown in FIG. 3 is an aperture 66. Similarly, centrally located in the base member cover 60 near the left side thereof is an aperture 68. The apertures 66 and 68 in the base member cover 60 will be aligned with the apertures 40 and 42 in the base member housing 30 (FIG. 1), respectively, when the base member cover 60 is placed either on the top face or on the bottom face of the base member housing 30.

Four additional apertures 70, 72, 74, and 76 are respectively located near the four corners of the base member cover 60. The apertures 70 and 72 are located near the right side of the base member cover 60, while the apertures 74 and 76 are located near the left side of the base member cover 60 as shown in FIG. 3. The apertures 70 and 74 are located near the side of the base member cover 60 shown on the top in FIG. 3, while the apertures 72 and 76 are located near the side of the base member cover 60 shown on the bottom in FIG. 3.

The apertures 70 and 72 in the base member cover 60 will be aligned with the apertures 44 and 46 in the base member housing 30 (FIG. 1) when the base member cover 60 is placed either on the top face or on the bottom face of the base member housing 30. Similarly, the apertures 74 and 76 in the base member cover 60 will be aligned with the apertures 48 and 50 in the base member housing 30 when the base member cover 60 is placed either on the top face or on the bottom face of the base member housing 30.

Completing the construction of the base member cover 60 are a pair of apertures 78 and 80, which are located near edges shown on the top and the bottom of the base member cover 60 in FIG. 3. The apertures 78 and 80 are placed so that one of them will be aligned with the pin 52 of the base member housing 30 (FIG. 3) if the base member cover 60 is placed on the top face of the base member housing 30, or with the pin 54 of the base member housing 30 if the base member cover 60 is placed on the bottom face of the base member housing 30. In the preferred embodiment, the base member cover 60 is very thin and is made of steel.

Figure 4:
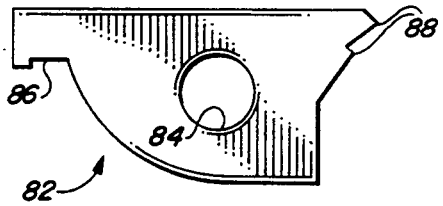
FIG. 4 is a top plan view of a pawl member which will be pivotally mounted in the interior of the base member housing illustrated in FIGS. 1 and 2.

Referring next to FIG. 4, a pawl member 82 is illustrated, which pawl member 82 is for ultimate placement in the second segment 34 of the hollowed-out interior of the base member housing 30 (FIG. 1)- The pawl member 82 has an aperture 84 located therein, which aperture 84 is larger than the aperture 64 in the base member cover 60 (FIG. 3). The aperture 84 will be aligned with the aperture 64 in the base member covers 60 when the pawl member 82 is placed in the second segment 34 of the hollowed-out interior of the base member housing 30 with the base member covers 60 placed on the top and bottom faces of the base member housing 30.

The left side of the pawl member 82 includes a notch 86 in the bottom side thereof as shown in FIG. 4. The purpose of this notch 86 is to receive an end of a small spring (not shown in FIG. 4), as will become evident below. The right side of the pawl member 82 includes two pawls 88 located near the top side thereof as shown in FIG. 4. The purposes of these pawls 88 will also become evident below. In the preferred embodiment, the pawl member 82 is made of steel.

Figure 5:
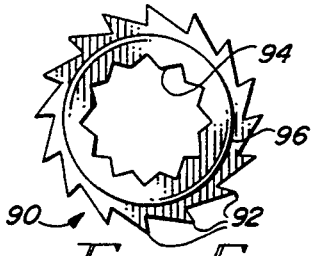
FIG. 5 is a top plan view of a ratchet wheel which will be rotatably mounted in the interior of the base member housing illustrated in FIGS. 1 and 2, and which will be limited in its direction of rotation by the pawl member illustrated in FIG. 4.
Figure 6:
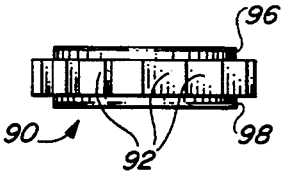
FIG. 6 is a side view of the ratchet wheel illustrated in FIG. 5, showing cylindrical projections extending from the top side and the bottom side thereof.

Referring now to FIGS. 5 and 6, a ratchet wheel 90 is illustrated; the ratchet wheel 90 is for ultimate placement in the first segment 32 of the hollowed-out interior of the base member housing 30 (FIG. 1). The ratchet wheel 90 includes a plurality of teeth 92 on the outer periphery thereof. The outer diameter of the teeth 92 of the ratchet wheel 90 is slightly smaller than the diameter of the first segment 32 of the hollowed-out interior of the base member housing 30.

There is a machined passage 94 extending through the ratchet wheel 90, as shown in FIG. 5. In the preferred embodiment, the machined passage 94 is made to accept a hexagonal member (not shown in FIG. 5). Cylindrical projections 96 and 98 extend from the top side and the bottom side, respectively, of the ratchet wheel 90. The machined passage 94 extends through the cylindrical projections 96 and 98. The cylindrical projections 96 and 98 are of a smaller diameter than the outer diameter of the teeth 92 of the ratchet wheel 90, and are designed to be received in the apertures 62 in two base member covers 60 (FIG. 3) located on the top and bottom faces, respectively, of the base member housing 30 (FIG. 1). In the preferred embodiment, the ratchet wheel 90 is made of steel.

Figure 7:
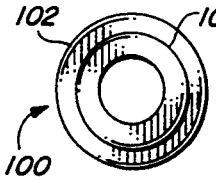
FIG. 7 is a top plan view of a cylindrical pivot pin which will be used to pivotally mount the pawl member illustrated in FIG. 4.
Figure 8:
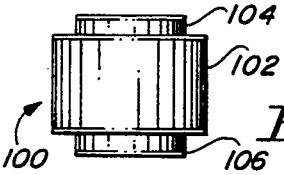
FIG. 8 is a side view of the cylindrical pivot pin illustrated in FIG. 7, showing cylindrical projections extending from the top side and the bottom side thereof.

Referring next to FIGS. 7 and 8, a cylindrical pivot pin 100 is illustrated. The cylindrical pivot pin 100 will extend through the aperture 84 in the pawl member 82 (FIG. 4) to support the pawl member 82 pivotally in the second segment 34 of the hollowed-out interior of the base member housing 30 (FIG. 1). The central portion 102 of the cylindrical pivot pin 100 is sized to fit easily into the aperture 84 of the pawl member 82. Extending from the top side and the bottom side of the central portion 102 of the cylindrical pivot pin 100 are smaller diameter cylindrical projections 104 and 106, respectively. The diameters of the cylindrical projections 104 and 106 are designed to be received in the apertures 64 in two base member covers 60 (FIG. 3) placed on the top and bottom faces of the base member housing 30 (FIG. 1). In the preferred embodiment, the cylindrical pivot pin 100 is made of steel.

Referring now to FIG. 8, the base member housing 30 illustrated in FIGS. 1 and 2 is shown with a base member cover 60 of FIG. 3 mounted on the bottom face thereof. The ratchet wheel 90 is rotatably mounted in the first segment 32 of the hollowed-out interior of the base member housing 30, with the cylindrical projection 98 of the ratchet wheel 90 (not shown in FIG. 9) received in the aperture 62 (also not shown in FIG. 9) of the base member cover 60.

The cylindrical pivot pin 100 is located with its cylindrical projection 106 (not shown in FIG. 9) being received in the aperture 64 (also not shown in FIG. 9) of the base member cover 60. The pawl member 82 is installed in the second segment 34 of the hollowed-out interior of the base member housing 30, with the aperture 84 of the pawl member 82 being located on the central portion 102 of the cylindrical pivot pin 100.

Figure 9:
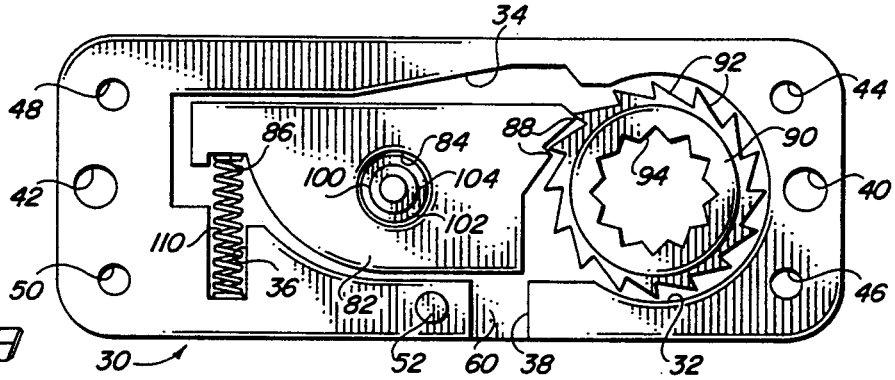
FIG. 9 is a top plan view of the base member housing illustrated in FIGS. 1 and 2 with one of the base member covers illustrated in FIG. 3 mounted on the bottom of the base member housing, showing the ratchet wheel illustrated in FIGS. 5 and 6 mounted in the base member housing, and also showing the pawl member illustrated in FIG. 4 mounted in the base member housing and biased by a spring into engagement with the ratchet wheel.

A spring 110 is located in the third segment 36 of the hollowed-out interior of the base member housing 30. The end of the spring 110 extending from the third segment 36 of the hollowed-out interior of the base member housing 30 into the second segment 34 of the hollowed-out interior of the base member housing 30 fits into the notch 86 in the pawl member 82. Thus, the spring 110 biases the pawl member 82 in a clockwise direction as shown in FIG. 9. This will urge the pawls 88 of the pawl member 82 into contact with the teeth 92 of the ratchet wheel 90.

It will at once be appreciated that the pawl member 82 is biased by the spring 110 into contact with the teeth 92 of the ratchet wheel 90 to allow the ratchet wheel 90 to rotate in only one direction. Specifically, as shown in FIG. 9, the ratchet wheel 90 can rotate only in a clockwise direction. Counterclockwise rotation of the ratchet wheel 90 will be prevented by the interaction of the teeth 92 of the ratchet wheel 90 with the pawls 88 of the pawl member 82, unless a screwdriver or like tool is inserted through the access slot 38 to force the pawls 88 of the pawl member 82 away from the teeth 92 of the ratchet wheel 90.

Referring next to FIGS. 10 and 11, the apparatus illustrated in FIG. 9 has another base member cover 60 placed on top of the base member housing 30. Rivets 112 are used to hold the base member covers 60 in place on the top face and the bottom face of the base member housing 30. The apparatus illustrated in FIGS. 10 and 11 is thus a completed base member 120. Note that if so desired, the base member covers 60 may be made with countersunk apertures 70, 72, 74, and 76 (FIG. 3) to allow the rivets 112 to be flush with the surfaces of the base member covers 60.

Referring next to FIGS. 12 and 13, a display pivot member 130 constructed according to the teachings of the present invention is illustrated. The display pivot member 130 includes an adjustment wheel 132 located at the top of the display pivot member 130. The adjustment wheel 132 includes six notches 134 located in the outer periphery of the adjustment wheel 132 at evenly spaced intervals. The notches 134 will be used to rotate the display pivot member 130 for adjustment purposes, as will become evident below.

The display pivot member 130 also includes an engagement member 136 located at the bottom of the display pivot member 130. The engagement member 136 of the preferred embodiment is hexagonal, as best shown in FIG. 12, and is sized to fit into engagement with the machined passage 94 of the ratchet wheel 90 (FIG. 10). Extending through the display pivot member 130 is an aperture 138 best shown in FIG. 10, which in the preferred embodiment is square in cross-sectional configuration. In the preferred embodiment, the display pivot member 130 is made of steel.

Now moving to FIG. 14, a square insertion pin 140 is illustrated which will be used to mount the door closer mechanism to a display door (not shown). The square insertion pin 140 is for installation into the top or bottom of a display door at its pivot point. The body 142 of the square insertion pin 140 can be square (as shown) or round (not shown) in cross-section, with a circular flange 144 located at one end thereof. An aperture 146 extends through the square insertion pin 140, as best shown in FIG. 14.

The body 142 of the square insertion pin 140 is designed to fit into a square channel 161 forming part of the frame of a display door (shown) by dotted lines in FIG. 16. In the preferred embodiment, the square insertion pin 140 may be made of aluminum and dimensioned so as to provide a friction fit within channel 161. The body 142 of the square insertion pin 140 is approximately seven-sixteenths of an inch square and one inch long, and the circular flange 144 is approximately seven-eighths of an inch in diameter.

Turning next to FIG. 16, the door closer apparatus of the present invention is illustrated in complete form, as it will be installed in a display door (not shown in FIG. 16). The base member 120 will be mounted on the door frame (not shown in FIG. 16) on the top of the bottom member of the door frame, at the bottom pivot point for the display door. The side of the base member 120 in which the ratchet wheel 90 is mounted will be nearest the side of the frame the display door pivots from. The base member 120 is secured to the door frame with two screws (not shown) extending through the sequences of apertures 60, 40, and 60 at one side of the base member 120 and through the sequence of apertures 60, 42, and 60 at the other side of the base member 120.

A square insertion pin 140 will be installed in the square channel 161 of the pivoting side member of the display door (not shown in FIG. 16), with the body 142 of the square insertion pin 140 oriented upwardly and the circular flange 144 located at the bottom of the display door. If desired, a washer (not shown) can be disposed below flange 144. A second square insertion pin similar to pin 140 can be installed in the top of the pivoting side member of the display door, with the body of such square insertion pin oriented downwardly with its circular flange located at the top of the display door.

A square, spring steel rod 150 extends through the channel 161 and through opening 146 in square insertion pin 140 which will be installed in the bottom of the display door, with the bottom end 151 extending below pin 146 into opening 138 and the top end of the rod 150 extending above the top of the locking square 162 which is positioned within square channel 161 of the display door. Locking square 162 is substantially the same size as channel 161 and accordingly cannot rotate therein. The square top end of 153 of rod 150 is disposed within opening 163 of locking square 162 and cannot rotate with respect thereto. Lower end 151 can rotate with respect to channel 161. If desired, a plastic sheath 160 can be provided over rod 150 to provide sound-deadening qualities. The rod 150 rotates easily within the aperture 146 in the square insertion pins 140, but cannot rotate within locking square 162. The rod 150 is preferably made of $\frac{1}{8}$"0 spring steel. The top end 153 of rod 150 can be twisted or otherwise distorted to prevent locking square 162 from falling off.

The top end 153 of the rod 150 is securely mounted in the aperture 163 of the locking square 162, so that they act as a single unit.

It will now be appreciated by those skilled in the art that the base member 120 may be used to place a preloading bias on the rod 150 by turning the display pivot member 130. The ratcheting mechanism in the base member 120 will allow the rod 160 to be biased in a manner to cause the display door (not shown in FIG. 16) to close. The ratcheting mechanism in the base member 120 will thus allow the rod 150 to be preloaded only in this direction, and will retain the rod 150 in a preloaded condition.

If too much bias is placed on the rod 150, the bias may be released by placing the tip of a screwdriver (not shown) into the access slot 38 to contact the pawl member 82 (FIG. 10). In this manner, the pawls 88 of the pawl member 82 may be moved away from contact with the teeth 92 of the ratchet wheel 90 (against the force of the spring 110). When the tip of the screwdriver is removed, the pawls 88 of the pawl member 82 will move back into contact with the teeth 92 of the ratchet wheel 90. The apparatus may then be adjusted again to preload the bias on the torsion tube 160 as previously described.

Figure 17:
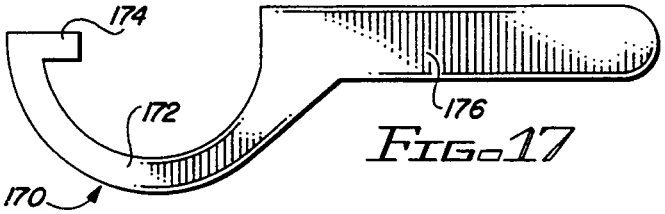
FIG. 17 is a wrench which may be used instead of a straight rod to adjust the door closing mechanism of the present invention by engaging the adjusting wheel of the display pivot member illustrated in FIGS. 12 and 13.

While a conventional tool (not shown) may be used to adjust the display pivot member 130 by using the notches 134 in the adjustment wheel 132 of the display pivot member 130 (FIG. 12), a custom tool such as the custom tool 170 illustrated in FIG. 17 may also be utilized. The custom tool 170 has a curved section 172 sized to fit around approximately half of the adjustment wheel 132. At one end of the curved section 172 of the custom tool 170 is a radially inwardly extending tooth 174, which will fit into one of the notches 134 in the adjustment wheel 132. The other end of the curved section 172 of the custom tool 170 is attached to a handle 176.

Figure 18:
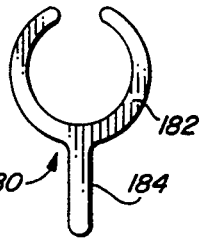
FIG. 18 is a top plan view of a door retainer clip used on the cylinder at the top end of the rod illustrated in FIG. 16, which door retainer clip is for engagement with the cylinder at the top end of the rod to retain a display door in place in a door frame.
Figure 21:
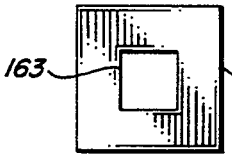
FIG. 21 is a top view of the locking member shown in FIG. 16.
Figure 19:
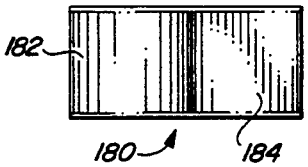
FIG. 19 is a side view of the door retainer clip illustrated in FIG. 18.

Referring now to FIGS. 18 and 19, a door retainer clip 180 for installation on the door is illustrated. The display door (not shown) is installed by the engagement member 136 of the display pivot member 130 into the machined passage 94 of the ratchet wheel 90 in the base member 120 by lowering the display door slightly.

The door retainer clip 180 has a C-shaped portion 182 which is designed to snap onto the cylinder 154 in the space between the bottom of the top door frame member and the top of the display door. Thus, the door retainer clip 180 will prevent the display door from being removed from the door frame unless and until the door retainer clip 180 is first removed. The door retainer clip 180 has an arm 184 extending from the side of the C-shaped portion 182 of the door retainer clip 180. The arm 184 of the door retainer clip 180 is used to facilitate installation and removal of the door retainer clip 180 onto the cylinder 154.

Figure 20:
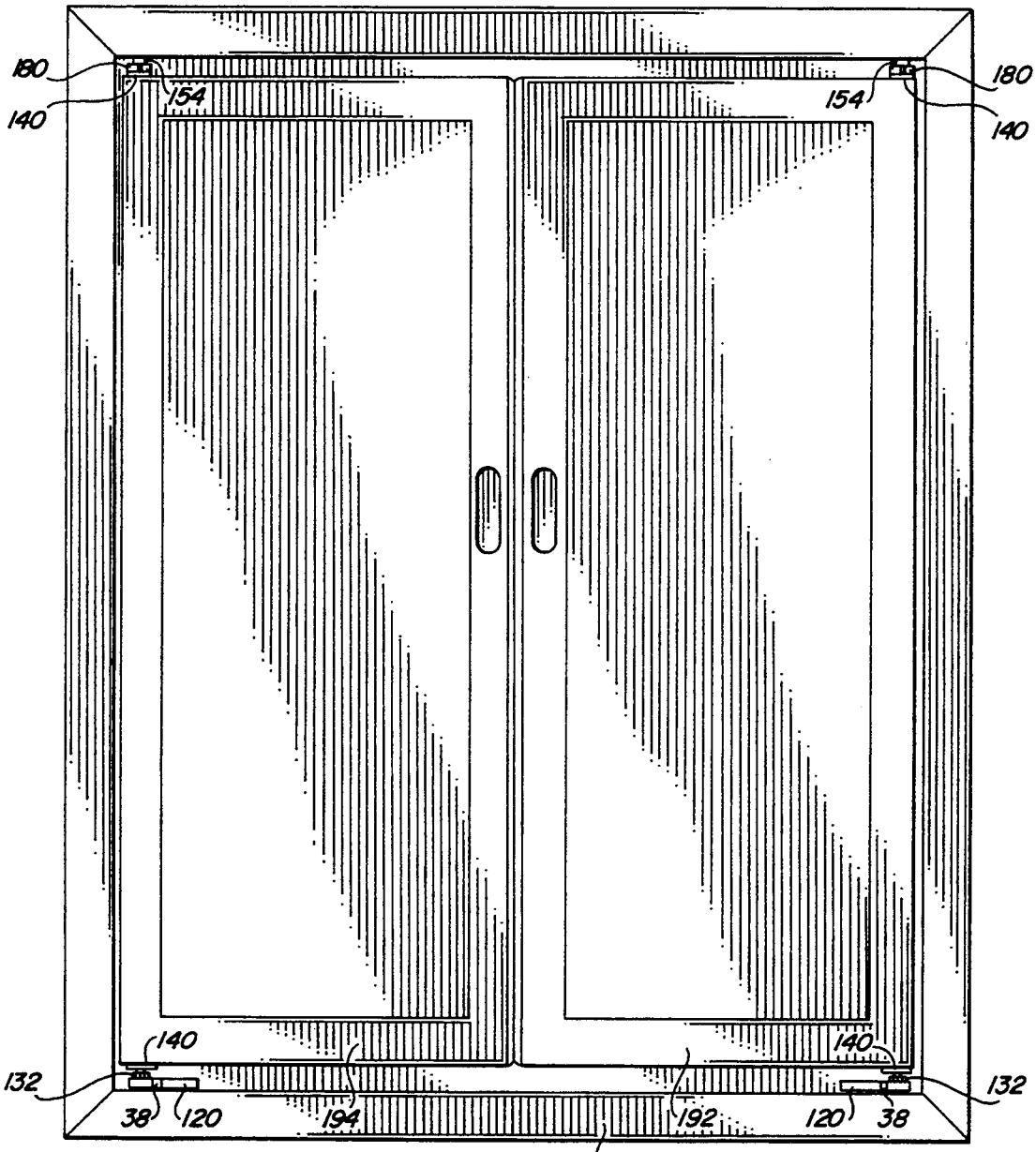
FIG. 20 is a front view of two display doors mounted in a door frame using the apparatus of the present invention illustrated in the previous figures.

Turning finally to FIG. 20, a door frame 190 for a display case is illustrated with a right display door 192 and a left display door 194 installed therein. The installation of the door closer hardware and the method of operation are both as described above with reference to FIG. 16. It should be noted that the same the base member 120 is used on both sides of the door frame 190 to adjust the preloading bias used to close both of the display doors 192 and 194. On the right side of the door frame 190, a first base member 120 is installed with the top side as shown in FIGS. 9 through 11 located upwardly, while on the left side of the door frame 190, a second base member 120 is installed with the bottom side as shown in FIGS. 9 through 11 located upwardly.

It may therefore be appreciated from the above detailed description of the preferred embodiment of the present invention that it teaches an improved adjustment mechanism for adjusting the bias which will be exerted by the biasing member used to close a display door. As such, the improved door closer adjustment mechanism of the present invention features improvements in two significant aspects. First, the improved door closer adjustment mechanism of the present invention is substantially easier to adjust than previously known door closer mechanisms, allowing a user to easily and precisely adjust the degree of bias which will be exerted by the biasing member used to close the display door. Second, the improved door closer adjustment mechanism positively and surely retains the precise adjustment setting over a period of time, and as such is not susceptible to the failure mode exhibited by previously known door closer mechanisms.

In addition, the improved door closer mechanism of the present invention is small in size, and thus does not require any more space to install than do previously known door closer mechanisms. The improved door closer adjustment mechanism of the present invention is also usable to replace existing door closure mechanisms without requiring either replacement or extensive modification of existing display doors. A single mechanism constructed according to the teachings of the present invention is equally usable either on a display door with its pivot point on the right side, or on a display door with its pivot point on the left side.

The improved door closer mechanism of the present invention is also of a construction which is both durable and long lasting, and which requires little or no maintenance to be provided by the display door user. The market appeal of the improved door closer mechanism of the present invention is also enhanced since it is of relatively inexpensive construction to thereby afford it the broadest possible market. Finally, all of the aforesaid advantages and objectives of the present invention are achieved without incurring any substantial relative disadvantage.

Although an exemplary embodiment of the present invention has been shown and described with reference to particular embodiments and applications thereof, it will be apparent to those having ordinary skill in the art that a number of changes, modifications, or alterations to the invention as described herein may be made, none of which depart from the spirit or scope of the present invention. All such changes, modifications, and alterations should therefore be seen as being within the scope of the present invention.

What is claimed is:

1. An apparatus for automatically closing a door mounted in a door frame, said automatic door closing apparatus comprising:

a base member for installation in the door frame at the bottom of the door frame and adjacent a first side of the door frame;

a display pivot member mounted on and engaged by said base member;

means for pivotally mounting the door by a first side thereof in the door frame adjacent the first side of the door frame, whereby the door pivots between an open position and a closed position, said display pivot member being located intermediate said base member and the door;

means for biasing the door from said open position to said closed position, said biasing means being operatively connected between the door and said display pivot member, whereby the preloading bias of said biasing means is adjusted by rotating said display pivot member with respect to said base member; and means, located in said base member, for ordinarily allowing rotation of said display pivot member with respect to said base member in a single direction only, wherein rotation of said display pivot member in said single direction acts to increase the preloading bias of said biasing means, which preloading bias of said biasing means in turn tends to pivot the door from said open position to said closed position; and wherein said base member comprises:

a base member housing; and a first member mounted for rotation in said base member housing with respect to said base member housing, said first member including means for engaging said display pivot member; and wherein said means for engaging said display pivot member comprises:

a passage extending through said first member which passage is machined to engage therein a member having a predetermined configuration; and wherein said display pivot member comprises:

an engagement member located on the side of said display pivot member facing toward said base member, said engagement member having said predetermined configuration for engagement with said passage of said first member; and wherein said base member housing is arranged and configured to allow said engagement member to engage said passage of said first member from either side of said base member housing.

2. An automatic door closing apparatus as defined in claim 1, wherein said means for ordinarily allowing rotation of said display pivot member with respect to said base member in said single direction only comprises:

means for ordinarily allowing said first member to rotate in said base member housing in said single direction only with respect to said base member housing.

3. An automatic door closing apparatus as defined in claim 2, wherein said first member comprises:

a ratchet wheel having a plurality of teeth located on the outer periphery thereof.

4. An automatic door closing apparatus as defined in claim 3, wherein said means for ordinarily allowing said first member to rotate in said base member housing in said single direction only with respect to said base member housing comprises:

a pawl member for engagement with said ratchet wheel; and means for biasing said pawl member into engagement with said ratchet wheel.

5. An automatic door closing apparatus as defined in claim 4, wherein said base member housing has an access slot located therein to allow a tool to be inserted to urge said pawl member away from engagement with said ratchet wheel, thereby allowing said ratchet wheel to rotate in a direction opposite to said single direction with respect to said base member housing.

6. An automatic door closing apparatus as defined in claim 2, additionally comprising:

means for temporarily disengaging said means for ordinarily allowing said first member to rotate in said base member housing in said single direction only with respect to said base member housing, thereby temporarily allowing said first member to rotate in a direction opposite said single direction with respect to said base member housing.

7. An automatic door closing apparatus as defined in claim 2, wherein said base member additionally comprises:

a pair of base member covers located on the top and the bottom of said base member housing, each of said base member covers allowing access to said means for engaging said display pivot member.

8. An automatic door closing apparatus as defined in claim 7, wherein said base member is approximately one-quarter of an inch thick.

9. An apparatus for automatically closing a door mounted in a door frame, said automatic door closing apparatus comprising:

a base member for installation in the door frame at the bottom of the door frame and adjacent a first side of the door frame;

a display pivot member mounted on and engaged by said base member;

means for pivotally mounting the door by a first side thereof in the door frame adjacent the first side of the door frame, whereby the door pivots between an open position and a closed position, said display pivot member being located intermediate said base member and the door;

means for biasing the door from said open position to said closed position, said biasing means being operatively connected between the door and said display pivot member, whereby the preloading bias of said biasing means is adjusted by rotating said display pivot member with respect to said base member; and means, located in said base member, for ordinarily allowing rotation of said display pivot member with respect to said base member in a single direction only, wherein rotation of said display pivot member in said single direction acts to increase the preloading bias of said biasing means, which preloading bias of said biasing means in turn tends to pivot the door from said open position to said closed position; and wherein said display pivot member comprises:

an adjustment wheel located on the side of said display pivot member facing toward the door, said adjustment wheel including a plurality of notches located in the outer periphery thereof at evenly spaced intervals for rotating said display pivot member for adjustment purposes.

10. An automatic door closing apparatus as defined in claim 9, additionally comprising:

tool means for engaging said adjustment wheel to rotate said display pivot member.

11. An automatic door closing apparatus as defined in claim 9, wherein said means for pivotally mounting the door comprises:

a rod extending within a channel in the side of the door and extending from the bottom of said door, a bottom end of said rod being mechanically connected to said display pivot member, a top end of said rod being mounted in the door frame.

12. An automatic door closing apparatus as defined in claim 11, additionally comprising:

a door retainer clip installed between the top of the door and the door frame to retain the door in the door frame.

13. An automatic door closing apparatus as defined in claim 11, additionally comprising:

an insertion pin mounted in fixed fashion in the bottom of the first side of the door, said rod extending through and rotating in said insertion pin.

14. An automatic door closing apparatus as defined in claim 13, wherein said biasing means comprises:

a spring steel rod, one end of which is attached to a locking member and the other end of which extends through and below said insertion pin.

15. An automatic door closing apparatus as defined in claim 9, wherein said base member is arranged and configured to enable it to be installed either right-side-up or upside-down, depending on whether the door is mounted at the right side thereof or at the left side thereof.

16. An apparatus for automatically closing a door mounted in a door frame, said automatic door closing apparatus comprising:

a base member for installation in the door frame at the bottom of the door frame and adjacent a first side of the door frame, said base member comprising a first member mounted within said base member housing for rotation with respect to said base member housing;

a display pivot member mounted on and engaged by said base member, wherein said first member includes means for engaging said display pivot member;

means for pivotally mounting the door by a first side thereof in the door frame adjacent the first side of the door frame, whereby the door pivots between an open position and a closed position, said display pivot member being located intermediate said base member and the door;

means biasing the door from said open position to said closed position, said biasing means being operatively connected between the door and said display pivot member, whereby the preloading bias of said biasing means is adjusted by rotating said display pivot member with respect to said base member;

directional means, located in said base member, for ordinarily allowing rotation of said first member with respect to said base member in a single direction only, wherein rotation of said display pivot member in said single direction acts to increase the preloading bias of said biasing means, which preloading bias of said biasing means in turn tends to pivot the door from said open position to said closed position; and means for allowing the temporary disengagement of said directional means.

* * * * *